US005264784A

United States Patent [19]

Ortiz

[11] Patent Number: 5,264,784

[45] Date of Patent: Nov. 23, 1993

[54] CURRENT MIRROR WITH ENABLE

[75] Inventor: Jeffery P. Ortiz, Chandler, Ariz.

[73] Assignee: Motorola, Inc., Schaumburg, Ill.

[21] Appl. No.: 906,194

[22] Filed: Jun. 29, 1992

[51] Int. Cl.[5] ..... G05F 3/16

[52] U.S. Cl. ..... 323/315; 307/296.6

[58] Field of Search ..... 323/315, 317, 318; 307/296.1, 296.6

[56] References Cited

U.S. PATENT DOCUMENTS 4,370,674 1/1983 Johnson et al. ..... 358/74
4,595,972 6/1986 Davis et al. ..... 363/15
4,612,496 9/1986 Hines ..... 323/315
4,786,856 11/1988 Metcalf et al. ..... 323/315
5,013,934 5/1991 Hobrecht et al. ..... 307/296.7

*Primary Examiner*—Steven L. Stephan
*Assistant Examiner*—Adolf Berhane
*Attorney, Agent, or Firm*—Bradley J. Botsch, Sr.

[57] ABSTRACT

A current mirror circuit that can be disabled has been provided. An enable signal is applied to the base of a transistor that drives the common bases of an emitter-coupled pair of transistors. A voltage level of the enable signal may be used to turn off the transistor which subsequently turns off and disables the emitter-coupled pair of transistors.

4 Claims, 1 Drawing Sheet

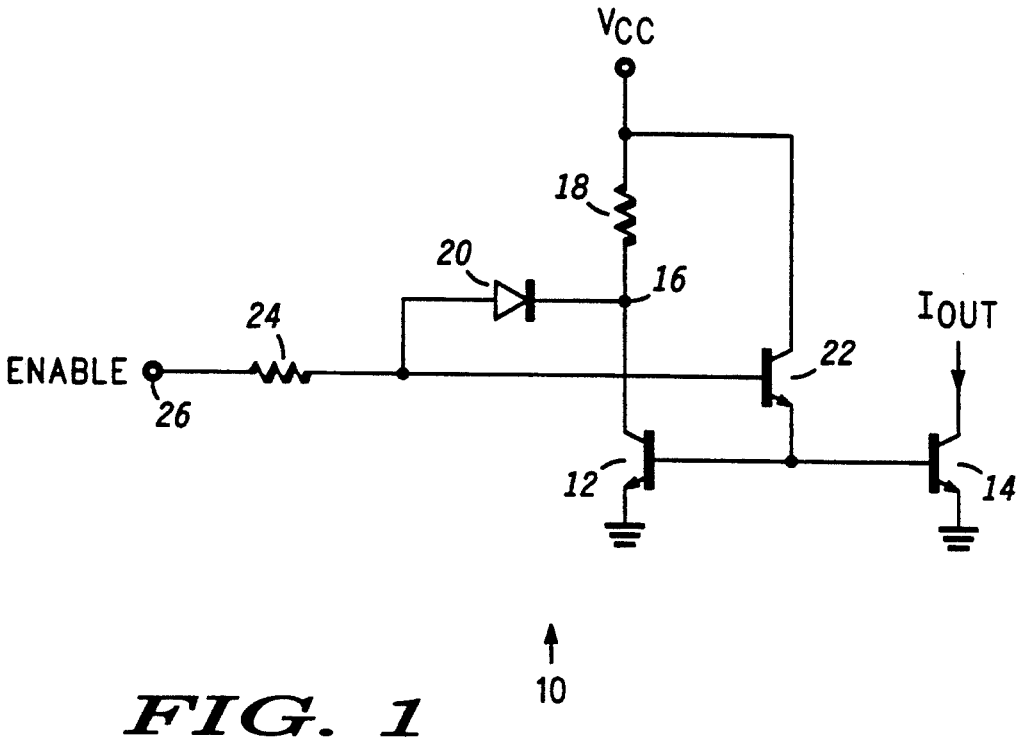
FIG. 1
FIG. 2
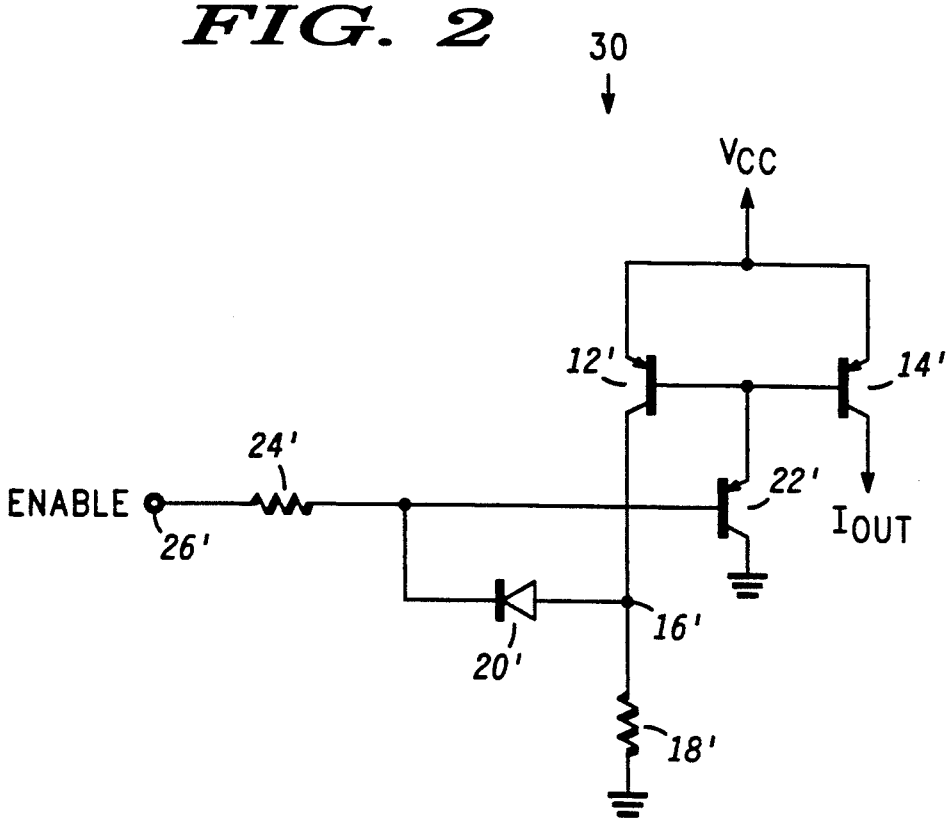

CURRENT MIRROR WITH ENABLE

FIELD OF THE INVENTION

This invention relates to current mirrors and, in particular, to a current mirror that can be enabled and operate at a current independent of the enable voltage.

BACKGROUND OF THE INVENTION

Current mirrors are utilized in a myriad in applications. Further, it is desirable to provide a current mirror that can be enabled (and thus disabled) especially when designing integrated circuits for portable products where power dissipation is critical. That is, by disabling a current mirror, substantial current drain can be eliminated when operating in a standby mode.

Typically, a current mirror consists of an input transistor and an output transistor wherein the bases of each are coupled together and the emitters of each are coupled to a first supply voltage terminal. One attempt for disabling a current mirror includes coupling the current carrying electrodes of an enable transistor between the collector of the input transistor of the current mirror and a second supply voltage terminal. Further, the base of the enable transistor is coupled to receive an enable signal. In general, the enable signal provides current to the current mirror through an emitter follower buffer (the enable transistor). However, this circuit suffers from two problems. First, the current in the current mirror is directly dependent upon the voltage of the enable signal. Second, the voltage appearing at the input of the current mirror is reduced by one diode drop due to the enable transistor. This will increase the temperature dependence of the current through the current mirror and will increase the minimum supply voltage that is required to operate the current mirror.

Another attempt at disabling a current mirror involves coupling the current carrying electrodes of an enable transistor between the common bases of the current mirror transistors and the first supply voltage terminal. Further, the base of the enable transistor is coupled to receive an enable signal. In general, the enable signal is used to pull the base voltage of the input transistor below its turn on voltage thereby disabling the current mirror. However, this circuit has the disadvantage of drawing substantial current even during standby mode.

Hence, there exists a need for an improve current mirror that can be disabled while minimizing the power dissipation.

SUMMARY OF THE INVENTION

Briefly, there is provided a current mirror circuit responsive to an enable signal comprising an emitter-coupled pair of transistors including a first and a second transistor each having a collector, a base and an emitter, the emitters of the first and second transistors are coupled to a first supply voltage terminal, the collector of the second transistor providing an output current of the current mirror circuit. A third transistor has a collector, a base and an emitter, the collector of the third transistor is coupled to a second supply voltage terminal, the emitter of the third transistor is coupled to the base of the first transistor. A first resistor is coupled between the collector of the first transistor and the second supply voltage terminal. An enable circuit is responsive to the enable signal and coupled to the collector of the first transistor and the base of the third transistor for maintaining a voltage appearing at the base and collector of the first transistor substantially equal when the enable signal exceeds a predetermined threshold and for turning off the third transistor and subsequently disabling the current mirror circuit when the enable signal falls below a predetermined threshold.

The present invention will be better understood from the following detailed description taken in conjunction with the accompanying drawings.

BRIEF DESCRIPTION OF THE DRAWINGS

FIG. 1 is a detailed schematic diagram illustrating a current mirror circuit that can be disabled in accordance with the present invention; and FIG. 2 is a detailed schematic diagram illustrating an alternate embodiment of a current mirror circuit that can be disabled in accordance with the present invention.

DETAILED DESCRIPTION OF THE DRAWINGS

Referring to FIG. 1, current mirror circuit 10 which can be disabled is shown. Current mirror circuit 10 includes emitter-coupled pair of transistors 12 and 14 wherein input current mirror transistor 12 has an emitter returned to ground reference, and a base coupled to the base of output current mirror transistor 14. The emitter of transistor 14 is returned to ground, while the collector of transistor 14 provides the output current $I_{OUT}$ of current mirror circuit 10.

The collector of transistor 12 is coupled to circuit node 16 wherein circuit node 16 is coupled to operating potential $V_{CC}$ via resistor 18. Circuit node 16 is further coupled to the cathode of diode 20, while the anode of diode 20 is coupled to the base of transistor 22. Diode 20 and resistor 24 comprise an enable circuit which is responsive to the voltage level of signal ENABLE applied at terminal 26. The collector of transistor 22 is coupled to operating potential $V_{CC}$, while the emitter of transistor 22 is coupled to the base of transistor 12 thereby reducing the beta error due to transistor 12. Finally, the base of transistor 22 is coupled through resistor 24 to terminal 26.

In operation, when the enable signal applied at terminal 26 reaches a predetermined threshold, transistor 22 and diode 20 will turn on and subsequently set the base and collector of transistor 12 to substantially the same voltage. As a result, the voltage across resistor 18 will be independent of the voltage applied at terminal 26. In particular, the current through resistor 18 ($I_{R18}$) and, thus, through current mirror circuit 10, can be expressed as shown in EQN. 1.

$$I_{R18}=[V_{CC}-V_{BE(tran\ 12)}-V_{BE(tran\ 22)}+V_{D20}]/R_{18} \quad (1)$$

where $R_{18}$ is the value of resistor 18;

$V_{BE(tran\ 12)}$ is the base-emitter voltage of transistor 12;

$V_{BE(tran\ 22)}$ is the base-emitter voltage of transistor 22; and $V_{D20}$ is the diode voltage across diode 20.

Assuming that the base-emitter voltages of transistors 12 and 22 and the diode voltage of diode 20 are substantially equal, EQN. 1 can be reduced to the simplified expression shown in EQN. 2.

$$I_{R18}=[V_{CC}-V_{BE}]/R_{18} \quad (2)$$

Thus, the current through current mirror circuit 10 will be independent of the voltage of the enable signal provided that resistor 24 is substantially larger than resistor 18.

On the other hand, when it is desired to disable current mirror circuit 10 such as during a standby mode, the signal applied at terminal 26 will fall below a predetermined threshold thereby turning off transistor 22 wherein transistor 22 will no longer provide base current to transistor 12. Thus, current mirror circuit 10 will be disabled. Note that when current mirror circuit 10 is disabled, there is no transistor that needs to be maintained operative and, thus, the standby current for current mirror circuit 10 (when disabled) is substantially zero.

Referring to FIG. 2, current mirror circuit 30 is shown. In particular, wherever current mirror circuit 10 of FIG. 1 utilized NPN transistors, current mirror circuit 30 of FIG. 2 utilizes PNP transistors. Further, it is understood that components shown in FIG. 2 which function similar to components shown in FIG. 1 are identified by like prime reference numbers.

In particular, in order to keep the base and collector of transistor 12' at substantially the same voltage, the polarity of diode 20' is reversed with respect to diode 20 since now transistor 2' is a PNP transistor. However, the operation of the circuit shown in FIG. 2 is similar to the operation shown in FIG. 1 with the exception that when it is desired to disable current mirror circuit 30, the voltage appearing at terminal 26' must be increased above a predetermined threshold thereby turning off transistor 22'.

By now it should be apparent from the foregoing discussion that a novel current mirror circuit that can be disabled has been provided. An enable signal is applied to the base of a transistor that drives the common bases of an emitter-coupled pair of transistors. A voltage level of the enable signal may be used to turn off the transistor which subsequently turns off and disables the emitter-coupled pair of transistors.

While the invention has been described in conjunction with specific embodiments thereof, it is evident that many alternations, modification, and variations will be apparent to those skilled in the art in the light of the foregoing description. Accordingly, it is intended to embrace all such alternations, modifications and variations in the appended claims.

I claim:

1. A current mirror circuit responsive to an enable signal, comprising:

an emitter-coupled pair of transistors including a first and a second transistor each having a collector, a base and an emitter, said emitters of said first and second transistors being coupled to a first supply voltage terminal, said collector of said second transistor providing an output current of the current mirror circuit;

a third transistor having a collector, a base and an emitter, said collector of said third transistor being coupled to a second supply voltage terminal, said emitter of said third transistor being coupled to said base of said first transistor;

a first resistor being coupled between said collector of said first transistor and said second supply voltage terminal; and enable means responsive to the enable signal and being coupled to said collector of said first transistor and said base of said third transistor for maintaining a voltage appearing at the collector of said first transistor substantially equal to a voltage appearing at the base of said first transistor when the enable signal exceeds a predetermined threshold thereby allowing a current flowing through said first transistor to be substantially independent of the enable signal and for turning off said third transistor and subsequently disabling the current mirror circuit when the enable signal falls below a predetermined threshold.

2. The current mirror circuit according to claim 1 wherein said enable means includes:

a diode having an anode and a cathode, said cathode of said diode being coupled to said collector of said first transistor, said anode of said diode being coupled to said base of said third transistor; and a second resistor being coupled between said base of said third transistor and a first terminal at which the enable signal is applied.

3. A current mirror circuit with enable comprising:

a first transistor having a collector, a base and an emitter, said emitter of said first transistor being coupled to a first supply voltage terminal;

a second transistor having a collector, a base and an emitter, said emitter of said second transistor being coupled to said first supply voltage terminal, said base of said second transistor being coupled to said base of said first transistor, and said collector of said second transistor providing an output current of the current mirror circuit;

a third transistor having a collector, a base and an emitter, said collector of said third transistor being coupled to a second supply voltage terminal, said emitter of said third transistor being coupled to said base of said first transistor;

a diode having an anode and a cathode, said cathode of said diode being coupled to said collector of said first transistor, said anode of said diode being coupled to said base of said third transistor;

a first resistor being coupled between said collector of said first transistor and said second supply voltage terminal; and a second resistor being coupled between said base of said third transistor and a first terminal at which an enable signal is applied, wherein a current flowing through said first transistor is substantially independent of the enable signal.

4. A current mirror circuit with enable, comprising:

a first transistor having a collector, a base and an emitter, said emitter of said first transistor being coupled to a first supply voltage terminal;

a second transistor having a collector, a base and an emitter, said emitter of said second transistor being coupled to said first supply voltage terminal, said base of said second transistor being coupled to said base of said first transistor, and said collector of said second transistor providing an output current of the current mirror circuit;

a third transistor having a collector, a base and an emitter, said collector of said third transistor being coupled to a second supply voltage terminal, said emitter of said third transistor being coupled to said base of said first transistor;

a diode having an anode and a cathode, said anode of said diode being coupled to said collector of said first transistor, said cathode of said diode being coupled to said base of said third transistor;

a first resistor being coupled between said collector of said first transistor and said second supply voltage terminal; and a second resistor being coupled between said base of said third transistor and a first terminal at which an enable signal is applied, wherein a current flowing through said first transistor is substantially independent of the enable signal.

* * * * *